US008691025B2

(12) United States Patent
Büsing et al.

(10) Patent No.: US 8,691,025 B2
(45) Date of Patent: Apr. 8, 2014

(54) DISHWASHER, IN PARTICULAR DOMESTIC DISHWASHER

(75) Inventors: Johannes Büsing, Emersacker (DE); Daniel Delle, Bächingen (DE); Gerhard Fetzer, Gundelfingen (DE); Peter Geissler, Holzheim (DE); Norbert Gerstner, Heidenheim (DE); Hubert Groll, Mödingen (DE); Mathias Herrmann, Nattheim (DE); Dieter Hotz, Dischingen (DE); Stefan Kasbauer, Dillingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 881 days.

(21) Appl. No.: 12/226,381

(22) PCT Filed: Apr. 3, 2007

(86) PCT No.: PCT/EP2007/053260

§ 371 (c)(1),
(2), (4) Date: Oct. 16, 2008

(87) PCT Pub. No.: WO2007/122082

PCT Pub. Date: Nov. 1, 2007

(65) Prior Publication Data

US 2009/0101182 A1 Apr. 23, 2009

(30) Foreign Application Priority Data

Apr. 21, 2006 (DE) ..... 10 2006 018 539

(51) Int. Cl.
*B08B 3/00* (2006.01)

(52) U.S. Cl.
USPC ..... 134/56 D; 134/57 D

(58) Field of Classification Search
USPC ..... 134/56 R, 113, 94.1
See application file for complete search history.

(56) References Cited

U.S. PATENT DOCUMENTS

| | | | | | |
|---|---|---|---|---|---|
| 1,798,425 | A | * | 3/1931 | Lindgren | 134/72 |
| 2,539,432 | A | * | 1/1951 | Jones | 134/131 |
| 2,759,767 | A | * | 8/1956 | McGaffey | 239/288 |
| 3,347,250 | A | | 10/1967 | Martiniak | |
| 3,903,911 | A | * | 9/1975 | Guth | 134/148 |
| 4,071,195 | A | * | 1/1978 | Kuhns et al. | 239/289 |

(Continued)

FOREIGN PATENT DOCUMENTS

| | | | |
|---|---|---|---|
| DE | 84 34 858 U | | 5/1985 |
| DE | 37 31 096 | * | 4/1989 |

(Continued)

OTHER PUBLICATIONS

International Search Report PCT/EP2007/053260.

*Primary Examiner* — Michael Barr
*Assistant Examiner* — Jason Ko
(74) *Attorney, Agent, or Firm* — James E. Howard; Andre Pallapies

(57) ABSTRACT

A dishwasher is provided that includes a washing space in which the soiled articles can be positioned for cleaning and an operating device that operates during the cleaning operation and is arranged in an opening in a bounding face of the washing space and/or of a container which can be positioned in the washing space. A spray device for spraying cleaning fluid is integrated into the washing space in the operating device.

23 Claims, 5 Drawing Sheets

(56) References Cited

U.S. PATENT DOCUMENTS

| | | | | |
|---|---|---|---|---|
| 6,460,555 | B1 | 10/2002 | Tuller et al. | |
| 6,622,740 | B1 * | 9/2003 | Durazzani | 134/201 |
| 6,675,818 | B1 * | 1/2004 | Schrott et al. | 134/57 D |
| 2005/0155633 | A1 | 7/2005 | Daume et al. | |

FOREIGN PATENT DOCUMENTS

| | | | |
|---|---|---|---|
| DE | 197 08 805 | | 10/1997 |
| DE | 101 49 627 | | 4/2003 |
| EP | 0 650 692 | | 5/1995 |
| EP | 0 755 650 | | 1/1997 |
| EP | 1 264 570 | | 12/2002 |
| EP | 1 676 520 | | 7/2006 |
| FR | 2 559 798 | * | 8/1985 |
| GB | 2 033 737 | | 5/1980 |
| GB | 2 321 590 | | 8/1998 |
| JP | 3-151927 | | 6/1991 |
| JP | 10-153470 | * | 6/1998 |
| JP | 2001-346747 | * | 12/2001 |
| JP | 2004-113683 | | 4/2004 |
| WO | WO 2005/060813 | | 7/2005 |

* cited by examiner

DISHWASHER, IN PARTICULAR DOMESTIC DISHWASHER

BACKGROUND OF THE INVENTION

The invention relates to a dishwasher, in particular a domestic dishwasher, comprising a washing container for accommodating soiled articles and at least one operating device for influencing and/or registering the biological and/or chemical and/or physical properties of the cleaning fluid, e.g. pH value, temperature, surface tension or hardness, in and/or on the washing container.

In order to improve cleaning efficiency in dishwashers, further spray devices—in the form of spray nozzles, for example—are often used in addition to at least one rotating spray, to prevent dirt being transferred back onto the dishes by the spray devices during the cleaning process. Various embodiments and arrangements of such spray devices are known from the prior art in this context.

Publication DE 84 34 858.5 U1 shows a dishwasher with an internal cavity in which spray nozzles are provided at the top on a convex cover plate fitted therein.

In JP 2004113683 A, a dishwasher is shown in which auxiliary nozzles are arranged on the rear wall of the washing space of the dishwasher.

Publication DE 1 628 596 A shows a dishwasher in which a nozzle for generating a fan-shaped water jet is provided in the upper area of the washing space close to the ceiling.

Document DE 29 42 051 A1 discloses a dishwasher which incorporates a container that can be accessed from above via an opening, said opening being closable by means of a top cover. Spray devices which are directed substantially downward are arranged inside said cover.

Document DE 197 08 805 A1 shows a dishwasher with a diagonally arranged crockery basket, with rinsing nozzles being arranged above and below said basket for cleaning. The upper rinsing nozzles are mounted in the ceiling of the washing space and the lower rinsing nozzles are configured on a cassette-type distributor on the floor of the washing space.

Publication JP 03151927 A discloses a dishwasher which has a spray nozzle on the ceiling of the washing space, with a cylindrical main body section and corresponding outlets in said main body section.

Publication DE 694 09 198 T2 discloses a dishwasher, the washing space of which is open at the top and wherein the dishes are held in the washing space through the opening by a user. The dishes are cleaned by means of nozzles arranged in the vicinity of the opening, said nozzles being integrated into the wall of the washing space.

Dishwashers known from the prior art for cleaning with the use of cleaning fluids have the disadvantage that the spray devices used are integrated into the washing space as separate components. This necessitates high costs in the manufacture of the dishwasher, since separate openings must be provided—in the walls of the washing space, for example—for the purpose of attaching the nozzles and separate ducts for supplying cleaning fluid to the spray devices.

BRIEF SUMMARY OF THE INVENTION

The object of the invention is therefore to produce a dishwasher which is of simple construction and is easy to manufacture.

This object is achieved by a dishwasher according to independent claim 1. Developments of the invention are defined in the dependent claims.

In a dishwasher according to the invention, in particular a domestic dishwasher, comprising a washing container for accommodating soiled articles and at least one operating device for influencing and/or registering the biological and/or chemical and/or physical properties of the cleaning fluid, e.g. pH value, temperature, surface tension or hardness, in and/or on the washing container, which, in particular, is not used for spraying cleaning fluid onto the soiled articles, at least one spray device for spraying cleaning fluid onto the soiled articles is integrated into the operating device, of which there is at least one.

The operating device is preferably installed in an opening or recess in a wall of the washing container.

This invention is based on the finding that spray devices in the washing space do not necessarily have to be configured separately from already existing operating components of the dishwasher. In particular, those operating devices for which an opening is provided in the wall, floor or top cover of the washing space, also assume the function of a spray device, since an access into the washing space from the outside is already created via the existing opening via which cleaning fluid may be dispensed for spraying in the washing space. The essence of the invention thus consists in that operating devices that are known per se, which do not primarily have the function of a spray device, are equipped with a spray device. This has the effect of reducing manufacturing costs for the dishwasher, since the walls of the washing space do not need to be provided with separate openings and through-holes for the spray devices.

In a particularly preferred embodiment of the invention, the operating device—of which there is at least one—is a device for releasing cleaning fluid and/or other additives into the washing space, or a sensor, e.g. for temperature and/or turbidity of the rinsing water and/or loading status and/or moisture. In particular, a cleaning fluid release system that is already integrated may be used for this purpose, in order to divert cleaning fluid for the spray devices away from this system. In this way the manufacture of the dishwasher is further simplified, since the integration of a separate cleaning fluid release system may be dispensed with.

The spray device is preferably integrated in the washing and/or rinsing water inlet system of the dishwasher. In addition, or alternatively, it is however also possible for the spray device in to be integrated in a dispenser device for the release of cleaning agent and/or rinsing agent and/or water softener.

In a further preferred embodiment of the invention, for the purpose of integrating the spray devices, operating devices are preferably used which are disposed in an upper area in the washing space, in particular in the top half, preferably in the upper third, and ideally in the upper quarter thereof. This enables the spray device to assume the function of a shower, thus effectively preventing dirt being transferred back onto the articles during the cleaning process. If the operating device in which the spray device is integrated is disposed in a lateral face extending upward from the floor, in a preferred embodiment of the invention the spray device is disposed in the upper area of the operating device. In this way the advantageous shower function of the spray device as described above may be achieved.

In a further embodiment of the inventive dishwasher, a plurality of spray devices is provided which are arranged at the same level and/or at a number of levels offset in relation to one another, with the levels advantageously running in a horizontal direction. This ensures particularly good cleaning in different areas of the washing space. In particular, cleaning can also be targeted at specific articles which are arranged in a predefined level in the washing space.

In a further embodiment of the invention the cleaning is effected mainly by means of a spray arm which, for example, is disposed in the lower area of the washing space. The spray devices constitute additional cleaning devices in this case. Nevertheless it is also possible, in a dishwasher, to use only such spray devices, or if appropriate other additional spray devices which are not designed as a spray arm.

In a particularly preferred embodiment a spray nozzle, which may be of highly compact design and can therefore easily be integrated into existing operating devices, is used as a spray device. The spray nozzle preferably comprises a nozzle body which is contained in a nozzle holder, said nozzle holder being connected to a cleaning fluid release system. This nozzle body is fastened into the nozzle holder by means of a bayonet joint, for example. To ensure particularly good distribution of the cleaning fluid in the washing space, the nozzle body advantageously has cleaning fluid outlets arranged in a fan shape.

In a particularly preferred embodiment of the invention the dishwasher is a so-called drawer dishwasher. The washing container consists of a container that is open at the top, i.e. a "drawer", having a floor and a periphery comprising a front wall, a rear wall and two side walls. The container, which is open at the top, is used for accommodating soiled articles for washing or rinsing. The container, which is open at the top, is moveable. When in the pulled-out position, the container, which is open at the top, is essentially outside the housing of the dishwasher, so that the user can load the soiled articles into and remove them from the container which is open at the top. When in the retracted position, the container, which is open at the top, is inside the housing of the dishwasher and is closed by a top cover so that it is watertight, to enable a washing operation to be carried out. In the upward extending periphery, the operating device, of which there is at least one, is arranged in the upper area of the periphery, in particular in the top half of periphery, and preferably in the upper third thereof. Since this operating device has a spray device, the spraying of the soiled articles from above is thereby guaranteed, i.e. a shower function is achieved without the spray device needing to be integrated in the top cover. This arrangement is preferred in drawer-type dishwashers, since the arrangement of the spray device in the top cover can be difficult to achieve structurally. This is based on the premise that the top cover remains inside the stationary dishwasher housing and the drawer or container that is open at the top cannot be pulled out. The cleaning fluid release system, however, is disposed in the drawer for the most part. It would therefore be necessary to provide costly connection devices which ensure that a connection for cleaning fluids runs between the stationary top cover and the moveable drawer. Such devices may be dispensed with if the spray device is already integrated into the moveable drawer itself.

BRIEF DESCRIPTION OF THE DRAWINGS

Exemplary embodiments of the invention are described below with the help of the enclosed figures.

In these.

DETAILED DESCRIPTION OF THE PRESENT INVENTION

Figure 1:
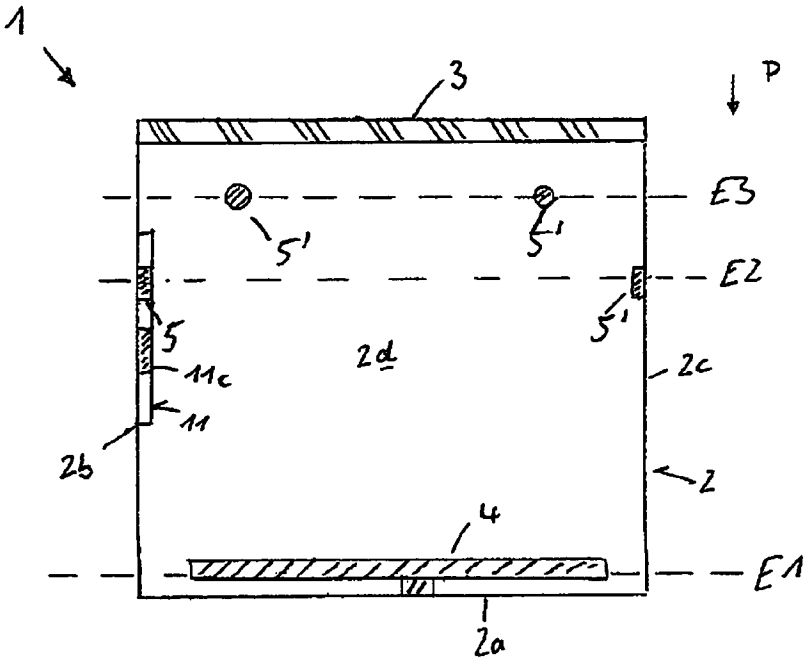
FIG. 1 shows a schematic, partially cut away front view of a container of a dishwasher according to the invention.

The embodiment of the invention shown in FIG. 1 relates to a drawer-type dishwasher, in which the dishes are placed in a container 2 which is open at the top. Said container 2 has a floor 2*a*, a rear wall 2*d* and two opposing side walls 2*b* and 2*c*, and a front wall (not shown). After the dishes have been loaded into the top opening of the container 2, the latter may be pushed into the housing of the inventive dishwasher, wherein—once the drawer has been pushed in—a top cover 3 is lowered in the direction P onto the top of the container, thereby sealing the container. The dishes are cleaned by a number of means including by at least one rotatable spray arm 4 or by at least one immobile spray pipe (known as a spray floor) on the floor 2*a* of the container 2*a*, said pipe being connected to a cleaning fluid inlet (not shown). The dishes are further cleaned by means of spray nozzles 5 and 5', which are provided in the upper area of the container. These spray nozzles 5' are arranged in separate openings on the rear wall of the container 2*d* and on the right-hand side wall 2*c*, and are likewise connected to a cleaning fluid inlet.

The inventive dishwasher according to FIG. 1 is distinguished in that a spray nozzle 5 is provided in a dispenser device 11 on the left-hand side wall 2*b* (for example) of the container 2. This means that there is no need for a further, separate opening in the container wall, since an existing opening which is provided for the dispenser device 11 is also used for the spray nozzle 5. The spray nozzles 5 and 5' and the dispenser device 11 are shown in schematic form in FIG. 1 and will be described in greater detail below. In the dispenser device shown in FIG. 1, however, it is indicated that the spray nozzle 5 is positioned in the upper area of the dispenser device below a device for the release of additives, wherein said release device is closed or may be opened by a lift-up lid 11*c* (see also FIG. 2).

Owing to the arrangement of the nozzle 5 and also of the nozzles 5' in the upper area of the container 2, said nozzles also essentially assume the function of a shower, without being integrated into the top cover 3. This arrangement is preferable for drawer dishwashers, since—as mentioned above—the integration of spray nozzles into the top cover 3 is difficult to accomplish structurally. The dishes are cleaned in the dishwasher shown in FIG. 1 in different levels. Firstly, the dishes are washed preferably by a spray arm 4, which is disposed at the lower level E1, by means of an upward-directed spray jet. Cleaning also takes place at two upper levels E2 and E3, each of which is provided with two spray nozzles 5 and 5'.

Figure 2:
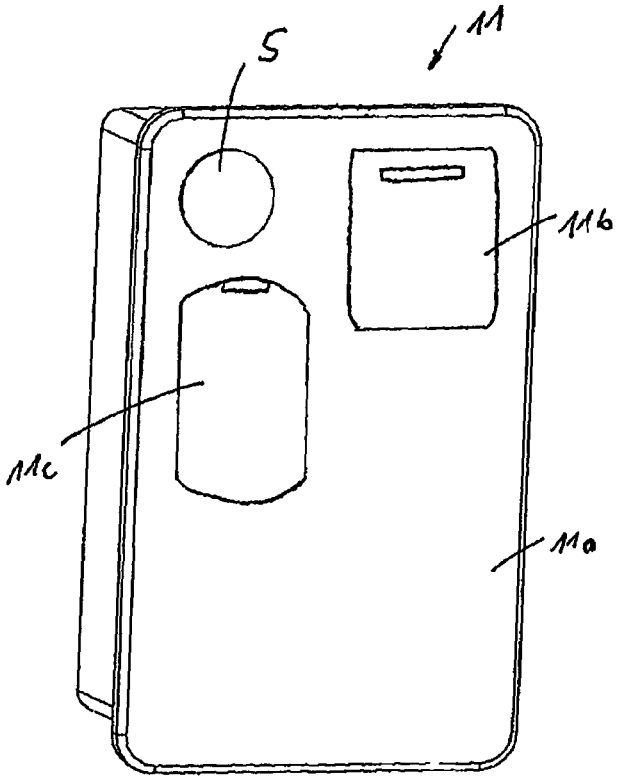
FIG. 2 shows a perspective view of a dispenser device, in which a spray nozzle is integrated according to the invention.

FIG. 2 shows a perspective view of the dispenser device 11 schematically illustrated in FIG. 1. The dispenser device essentially consists of a rectangular body with a front surface 11*a*, the edge of which projects over the rest of the body. The dispenser device is installed in a corresponding opening in the container 2 and is fixed to the container by a fixing means, for example a screw. The dispenser device comprises a lift-up lid 11*b*, behind which is a receptacle for the positioning of cleaning agents. The user inserts the cleaning agent into the dispenser device through the lift-up lid, and the lift-up lid opens at the prescribed time during the cleaning process in order to release the additive to aid cleaning. A further lift-up lid 11*c* is also provided, behind which is located a device for containing rinsing agent. Above the lift-up lid 11*c* is located the inventive spray nozzle 5, which is shown only in schematic form in FIG. 2. This spray nozzle 5 is connected to a cleaning fluid inlet (not shown), for example by means of a hose.

Figure 3:
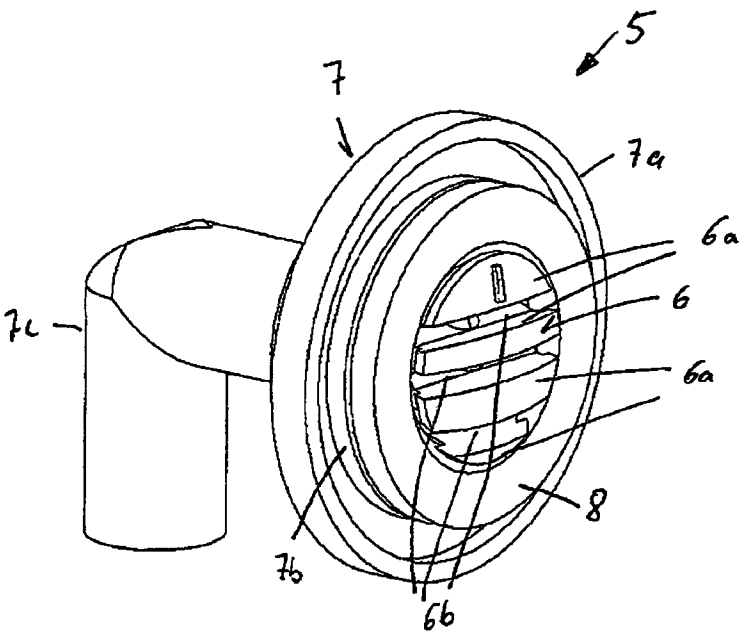
FIG. 3 shows a perspective view of a spray nozzle used in the invention.

A possible embodiment of the spray nozzle is shown in FIG. 3. This diagram shows a perspective view of a spray nozzle 5, as may be used in the inventive dishwasher shown in FIG. 1. The nozzle comprises a nozzle body 6, which is contained in a nozzle holder 7. The nozzle holder has a front section comprising an outer cylindrical ring 7*a* and an inner cylindrical ring 7*b*, between which an O-ring 9 (not visible in FIG. 3) is disposed, which—when installed—rests against the rear surface of the container wall and creates a seal preventing the leaking of spray water. On the interior of the inner ring 7*b* is located a cylindrical external screw thread 7*d* (not visible in FIG. 3), onto which a ring-shaped nut 8 with internal screw thread can be screwed. Once installed the inner surface of the ring-shaped nut rests against the inner surface of the container wall. The nozzle body 6 is inserted into the inner ring 7*b* by means of a bayonet joint (not shown).

At the rear end of the holder 7 is a pipe-shaped, bent connecting piece 7*c*, the lower end of the connecting piece being connected in a watertight manner to a corresponding cleaning fluid inlet, in particular a hose. The watertight seal may be achieved by any means known from the prior art, in particular a clamp-type connection between hose and connecting piece 7*c*. The front surface of the nozzle body 6 has essentially horizontally aligned slits or disks 6*a* which are arranged in a fan shape so that cleaning fluid outlets 6*b* are formed between the disks. Such a design of the nozzle body enables the spray jet to be well fanned out in order to remove the dirt from the dishes. The embodiment of the nozzle shown in FIG. 3 is nevertheless merely exemplary and other embodiments of a nozzle are also conceivable.

Figure 4:
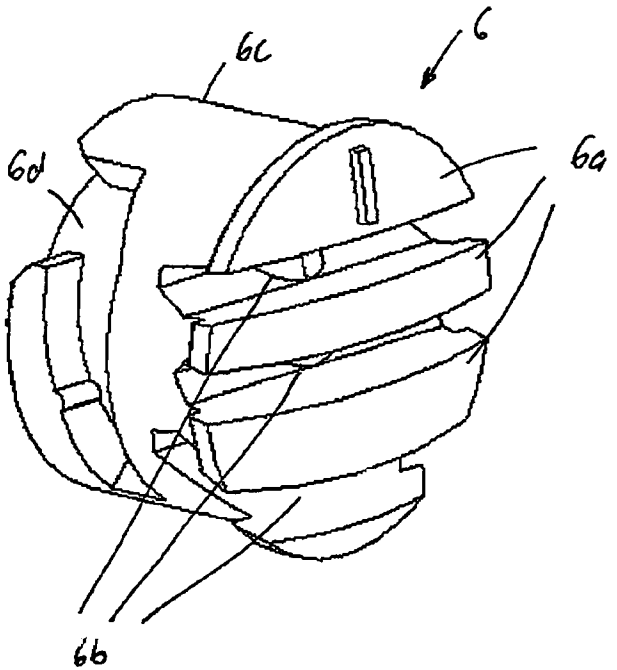
FIG. 4 shows an enlarged detailed view of the spray body of the spray nozzle shown in FIG. 3.

FIG. 4 shows an enlarged, perspective view of the nozzle body 6 shown in FIG. 3. To the front area of the nozzle body, which has the slits or disks 6*a* and the cleaning fluid outlets 6*b* lying between them, is connected an essentially cylindrical section 6*c*, at the rear end of which cleaning fluid enters the nozzle body. Also provided at the rear end of the section is a guide 6*d*, which forms one part of the bayonet joint for fixing the nozzle body into the holder 7.

Figure 5:
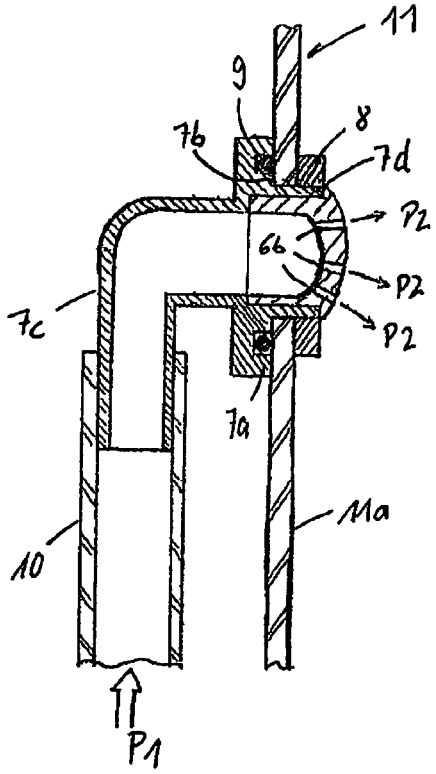
FIG. 5 shows a schematic cross-section which indicates how the inventive spray nozzle can be installed in the inventive dishwasher.

FIG. 5 shows a schematic cross-sectional view of the nozzle illustrated in FIG. 3 in its installed position in a wall of the container 2. For installation purposes the wall has an opening through which the cylindrical external screw thread 7*d* is pushed in, until the front surface of the inner ring 7*b* and of the outer ring 7*a* rests against the rear surface of the housing wall. Also visible from FIG. 5 is the O-ring 9, which is disposed in the space between inner ring 7*b* and outer ring 7*a* and which effects a seal for applying to the outer surface of the container. In order to fix the nozzle in the container, the nut 8 is screwed onto the external screw thread 7*c* from the inside of the container. Also visible from FIG. 4 is a piece of hose 10, which is plugged onto the lower end of the pipe-shaped connecting piece 7*c*. Water enters the nozzle from a water inlet via the hose, as indicated by the arrow P1. This water then passes through the openings 6*b* in the nozzle body 6 into the internal space in a fan formation, as indicated by the arrows P2.

LIST OF REFERENCE CHARACTERS

1 Dishwasher
2 Container
2*a* Floor
2*b*, 2*c* Side walls
2*d* Rear wall
3 Top cover
4 Spray arm
5, 5' Spray nozzle
6 Nozzle body
6*a* Disks
6*b* Cleaning fluid outlets
6*c* Cylindrical section
6*d* Guide
7 Nozzle holder
7*a* Outer ring
7*b* Inner ring
7*c* Connecting piece
7*d* External screw thread
8 Nut
9 O-ring
10 Hose
11 Dispenser device
11*a* Front surface
11*b*, 11*c* Lift-up lids

The invention claimed is:

1. A dishwasher comprising:

a washing container for accommodating items to be washed by a cleaning fluid, the washing container including an interior wall with an opening, wherein the opening provides a passage from an interior of the washing container to an exterior of the washing container;

an operating device operatively associated with the washing container for at least one of influencing and obtaining information concerning biological, chemical, and physical properties of the cleaning fluid including at least one of a property relating to pH value, temperature, surface tension, hardness; and a spray device for spraying cleaning fluid onto items in the washing container, wherein the operating device and the spray device are integrated into the opening.

2. The dishwasher as claimed in claim 1, wherein the operating device has a dispenser device for releasing additives into the washing container.

3. The dishwasher as claimed in claim 2, wherein the dispenser device is used for the release of cleaning agent and/or rinsing agent and/or water softener.

4. The dishwasher as claimed in claim 1, wherein the operating device is a sensor.

5. The dishwasher as claimed in claim 1, wherein the spray device is integrated in the water and/or rinsing water inlet system of the dishwasher.

6. The dishwasher as claimed in claim 1, wherein the operating device is disposed in an upper area in the washing container.

7. The dishwasher as claimed in claim 1, wherein the operating device is located in a front wall and/or rear wall and/or side wall of the washing container and/or in which the spray device.

8. The dishwasher as claimed in claim 1, wherein a plurality of spray devices is provided, which are arranged at the same level and/or at a number of levels offset in relation to one another, the levels running in a horizontal direction.

9. The dishwasher as claimed in claim 1, wherein at least one spray arm or spray pipe is provided, which is disposed in the lower area of the washing space.

10. The dishwasher as claimed in claim 1, wherein the spray device is a spray nozzle.

11. The dishwasher as claimed in claim 10, wherein the spray nozzle includes a nozzle body which is contained in a nozzle holder, the nozzle holder being connected to a cleaning fluid release system.

12. The dishwasher as claimed in claim 11, wherein the nozzle body is fixed into the nozzle holder by means of a bayonet joint.

13. The dishwasher as claimed in claim 11, wherein the nozzle body has cleaning fluid outlets arranged in a fan shape.

14. The dishwasher as claimed in claim 1, wherein the washing container for accommodating soiled articles can be pushed into the housing and—when the washing container is positioned outside of the housing—said washing container is open at the top for the loading and removal of soiled articles.

15. The dishwasher as claimed in claim 14, wherein the dishwasher is a drawer dishwasher, the washing container has a floor, two side walls, a rear wall and a front wall, and the operating device is disposed in the upper area of the side walls and/or rear wall and/or front wall.

16. The dishwasher as claimed in claim 1, wherein the operating device is installed in an opening or recess in a wall, covering wall, or top cover of the washing container.

17. The dishwasher as claimed in claim 1, wherein the operating device is disposed in the top half of the washing container.

18. The dishwasher as claimed in claim 1, wherein the operating device is disposed in the upper third of the washing container.

19. The dishwasher as claimed in claim 1, wherein the operating device is disposed in the upper quarter of the washing container.

20. The dishwasher as claimed in claim 1, wherein operating device includes a housing, the spray device is attached to the housing, and the housing is disposed in the opening.

21. The dishwasher as claimed in claim 1, wherein the opening is through the interior wall.

22. A dishwasher comprising:

a washing container for accommodating items to be washed by a cleaning fluid, the washing container including an interior wall with an opening, wherein the opening provides a passage from an interior of the washing container to an exterior of the washing container;

an operating means for at least one of influencing and obtaining information concerning biological, chemical, and physical properties of the cleaning fluid including at least one of a property relating to pH value, temperature, surface tension, hardness; and a spray means for spraying cleaning fluid onto items in the washing container, wherein the operating means and the spray means are integrated into the opening.

23. The dishwasher as claimed in claim 22, wherein the opening is through the interior wall.

* * * * *

UNITED STATES PATENT AND TRADEMARK OFFICE

CERTIFICATE OF CORRECTION

PATENT NO. : 8,691,025 B2
APPLICATION NO. : 12/226381
DATED : April 8, 2014
INVENTOR(S) : Büsing et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 421 days.

Signed and Sealed this
Twenty-ninth Day of September, 2015

Michelle K. Lee

Michelle K. Lee
*Director of the United States Patent and Trademark Office*